United States Patent [19]

Clark et al.

[11] 4,228,334

[45] Oct. 14, 1980

[54] DYNAMIC MICROWAVE ENERGY MODERATOR

[75] Inventors: Clarence O. Clark; Thomas J. Flautt, Jr.; Donald T. Speckman, all of Cincinnati, Ohio

[73] Assignee: The Procter & Gamble Company, Cincinnati, Ohio

[21] Appl. No.: 963,695

[22] Filed: Nov. 27, 1978

[51] Int. Cl.[3] ..... H05B 6/80

[52] U.S. Cl. ..... 219/10.55 E; 219/10.55 F; 426/107

[58] Field of Search ..... 219/10.55 E, 10.55 F, 219/10.55 M, 10.55 R; 426/107, 241, 243, 234

[56] References Cited

U.S. PATENT DOCUMENTS

| | | | |
|---|---|---|---|
| 3,219,460 | 11/1965 | Brown | 219/10.55 E X |
| 3,547,661 | 12/1970 | Stevenson | 219/10.55 E X |
| 4,013,798 | 3/1977 | Goltsos | 426/107 |
| 4,027,132 | 5/1977 | Levinson | 219/10.55 F |
| 4,144,435 | 3/1979 | Clark et al. | 219/10.55 E |
| 4,144,438 | 3/1979 | Gelman et al. | 219/10.55 E |

*Primary Examiner*—Arthur T. Grimley
*Attorney, Agent, or Firm*—Frost & Jacobs

[57] ABSTRACT

A dimensionally stable, temperature responsive microwave energy moderator. The moderator may comprise a sheet-like laminate having at least one lamina of microwave energy reflective material with at one aperture formed therein of such dimensions as to enable passage therethrough of a substantial portion of impinging microwave energy of a predetermined nominal frequency. At least one aperture-bridging microwave energy reflective member is provided together with means responsive to a predetermined temperature range to shift the aperture-bridging member from an inactive position to a position bridging the aperture, whereby to reduce the transmission of the microwave energy through the aperture. The moderator also has outer laminae of electrically insulative, microwave energy transmitting material with the microwave energy reflective lamina, the aperture-bridging means and the temperature responsive means located therebetween.

14 Claims, 7 Drawing Figures

DYNAMIC MICROWAVE ENERGY MODERATOR

TECHNICAL FIELD

The invention relates to a microwave energy moderator and more particularly to a dimensionally stable moderator configured to initially have a relatively high degree of microwave energy transmissibility and which, within a given predetermined temperature range, will transition to a state having a substantially lessened microwave energy transmissibility.

BACKGROUND ART

The microwave energy moderator of the present invention and wraps, bags or vessels utilizing it have many uses. The material to be subjected to the moderated microwave energy does not constitute a limitation of the present invention and the moderator can be constructed so as to be used with electromagnetic energy of various wavelengths, as will be evident to one skilled in the art.

For purposes of an exemplary showing, the moderator and its various embodiments will be described in their application to vessels, bags or wraps for foods to be prepared in a microwave oven.

In recent years the use of microwave ovens to heat or cook foods has increased markedly both in the home and in commercial establishments. This is true for numerous reasons. For example, microwave ovens require no pre-warming, heating efficiently and result in energy savings. Many foods demonstrate a superior taste when prepared in a microwave oven and retain more of their nutritional components. Microwave ovens are perhaps best known for the speed with which they heat or cook and they offer both the homemaker and the commercial establishment rapid reheating of refrigerated precooked foods.

Microwave ovens are not, however, without certain disadvantages. For example, heating or cooking by means of a microwave oven is so rapid that an error of several minutes (or sometimes less) can make the difference between a well done roast and a rare roast, or properly cooked foods and over-cooked foods. Each food product, itself, possesses characteristics having a marked influence on cooking or heating time. For example, such factors as the quantity of the food product to be heated or cooked, the size of the food product, the shape of the food product, its consistency and its dielectric properties all influence the rapidity and uniformity with which it will be heated or cooked in a microwave oven.

Furthermore, microwave ovens by different manufacturers differ in power outputs. Most domestic microwave ovens are produced with power outputs in the range of 600 watts to 1,000 watts at a nominal frequency of 2,450 MHz. The nominal wave length at this frequency is 12.2 cm. Another nominal frequency assigned to microwave cooking is 915 MHz with a nominal wave length of 33 cm.

Finally, the microwaves with the oven chamber tend in some places to reinforce each other and in other places tend to cancel each other. This phenomenon often results in hot and cold regions in food products being heated or cooked in a microwave oven. This effects non-uniform heating or cooking which is normally very undesirable.

All of the above noted factors result in the fact that heating or cooking with a microwave oven is generally more critical with respect to time and required attention than in conventional heating or cooking.

Prior art workers have attempted to solve some of the above noted problems by providing a variety of inventions directed towards improving the quality of microwave cooking. For instance, U.S. Pat. No. 3,219,460, issued Nov. 23, 1965, in the name of Eugene Brown, teaches a food container having several frozen foods therein, each requiring different cooking times. The container is made of microwave energy reflective material and is divided into compartments for each of the frozen foods. The container is provided with a microwave energy shielding cover. Those portions of the cover overlying each of the compartments are provided with microwave energy transmitting apertures, the number or configuration of which is selected to assure that the food product within each compartment is properly cooked or heated. A somewhat similar approach is taught in U.S. Pat. No. 3,547,661, issued Dec. 15, 1970, in the name of Peter N. Stevenson. This reference also teaches a container for selectively heating different items to different temperature levels simultaneously within a microwave oven. The vessel is generally microwave energy opaque, but opposite walls may be provided with areas of different microwave energy transmissivities. This is accomplished, for example, by making these opposite walls of microwave energy transparent material and coating them with aluminum. Various areas of these walls are provided with more or less aluminum coating (or no aluminum coating if maximum heating is to be achieved) corresponding to the various heating requirements of the food items these areas overlie.

U.S. Pat. No. 4,013,798, issued Mar. 22, 1977, in the name of Costas E. Goltsos, teaches another compartmented tray adapted to contain various food products. The tray is also provided with a specially formed shielding box, which box is provided with apertures so placed and sized as to control the quantity of microwave energy to which each of the food components is exposed within a given time period.

U.S. Pat. No. 4,027,132, issued May 31, 1977, to Melvin L. Levinson teaches a container for selectively defrosting and baking a frozen pie or pizza pie. The aparatus is constructed such that the crust of the pie is exposed to microwave radiation. The waste heat expended in the baking is used to heat the remainder of the pie which is shielded from the microwave radiation by a vapor-permeable, microwave-reflective member.

The above described prior art inventions are all static devices as opposed to the present invention which is a dynamic, thermally responsive microwave energy moderator which undergoes a dynamic change in its microwave energy transmissibility as its temperature is increased to a predetermined level or range.

Both static and dynamic microwave energy moderators are taught in the commonly owned copending application Ser. No. 854,941, filed Nov. 25, 1977, in the names of Thomas J. Flautt, Jr., Edward J. Maguire, Jr., and David L. Richardson and entitled MICROWAVE ENERGY MODERATOR. The static microwave energy moderators of this copending application are such that their relative degrees of transparency, transmissibility, attenuation and/or moderation of the microwave energy impinging thereon do not change substantially in use. Among other advantages, the use of the static moderators results in a substantially more uniform microwave energy field downstream thereof than the uniformity of the field would be absent such moderators. One of a number of examples of static moderators taught in this copending application comprises outer sheets of thermoplastic, microwave energy transmitting material and an intermediate sheet of microwave energy reflective material affixed or adhered to the outer thermoplastic sheets. The reflective sheet has a plurality of holes formed therein. The holes are so positioned and so sized as to render the moderator substantially transparent to microwave energy of a predetermined frequency range, yet sufficiently small and so spaced as to cause the microwave energy passing therethrough to be somewhat attenuated and/or moderated.

The dynamic embodiments of microwave energy moderators taught in this copending application are such that their relative degrees of transparency, transmissibility, attenuation and/or moderation of impinging microwave energy change substantially as the moderator is heated through a predetermined temperature range. Unlike the static embodiments and the dimensionally stable dynamic embodiments of the present invention, the dynamic embodiments of the copending application undergo substantial structural changes as they are heated to predetermined temperatures. One of a number of dynamic moderators taught in this copending application is similar to the static moderator just described with the exception that at least one of the thermoplastic sheets comprises a heat shrinkable thermoplastic film, which shrinks as it passes through a predetermined temperature range. When the film has shrunk, the effective sizes of the holes or apertures in the microwave energy reflective intermediate sheet are substantially reduced, since the shrinking action causes the microwave energy reflective sheet to crumple.

Both the static and dynamic microwave energy moderators of this copending application can be used as discrete microwave moderators, or they can be formed into wraps, bags, vessels, microwave oven liners, packages, containers or the like.

Another form of dynamic microwave energy moderator is taught in U.S. Pat. No. 4,144,435 issued Mar. 13, 1979 in the names of Clarence O. Clark, Robert L, DeAngelis, Kenneth F. Deffren, Thomas J. Flautt, Erwin A. Hofmann and Eugene Weinshenker. This copending application relates to various forms of vessels which are reflective to microwave energy. Each vessel has at least one aperture to permit the passage of microwave energy to its contents and a shielding device, responsive to a preselected internal temperature of the vessel contents, to close the at least one aperture to prevent further passage of microwave energy to the vessel contents.

The present invention is directed to a dynamic microwave energy moderator which may comprise a sheet-like laminate which is dimensionally stable and which transitions from a substantially transparent state with respect to microwave energy of predetermined frequency to a state wherein it is substantially less transparent to the microwave energy. This transition occurs in response to a predetermined temperature range through which the moderator passes. The sheet-like moderator of the present invention should be maintained generally planar for best operation and may be incorporated in microwave oven wraps or cooking vessels. For example, the moderator might constitute a cover for a disposable or reusable cooking vessel. It can also constitute a disposable element of a reusable vessel, being used as a disposable panel in the top, side walls, bottom or the like of the cooking vessel. Similarly, the moderator of the present invention can be used in the top, side walls, bottom or the like of a disposable cooking vessel. When used in conventional microwave oven cooking, the moderator of the present invention provides a number of benefits including more uniform doneness, reduced criticality of timing and reduced attention requirements.

DISCLOSURE OF THE INVENTION

In accordance with the present invention there is provided a temperature responsive, dimensionally stable microwave energy moderator. The moderator may comprise a sheet-like laminate having at least one lamina of microwave energy reflective material with at least one aperature formed therein of such dimensions as to enable passage therethrough of a substantial portion of impinging microwave energy of a predetermined nominal frequency. At least one aperture-bridging microwave energy reflective member is provided together with means responsive to a predetermined temperature range to shift the aperture-bridging member in an inactive position to a position bridging the aperture, whereby to reduce the transmission of the energy through the aperture. The moderator also has outer laminae of electrically insulative, microwave energy transmitting material with the lamina of microwave energy reflective material, the aperture-bridging means and the temperature responsive means located therebetween.

In one embodiment having an aperture in the form of an elongated slot, a plurality of slot-bridging elements are provided which, when shifted to their slot-bridging positions, effectively divide the slot into a plurality of shorter slots so as to substantially reduce the microwave energy transmissibility therethrough. In another embodiment, the slot is provided with a single slot-bridging position, substantially covers the entire slot to greatly reduce its microwave energy transmissibility. In both embodiments, the moderator may be provided with a plurality of slots, each having one or more slot bridging elements. A third embodiment is similar to either of the first two mentioned embodiments, differing only in that two microwave energy reflective laminae are provided. Both microwave energy reflective laminae have one or more slots formed therein, and their slots are arranged in registered pairs. A layer of microwave energy transmitting thermoplastic is located between the reflective laminae, as is also the bridging member (or members) for each registered pair of slots.

DETAILED DESCRIPTION OF THE INVENTION

Figure 1:
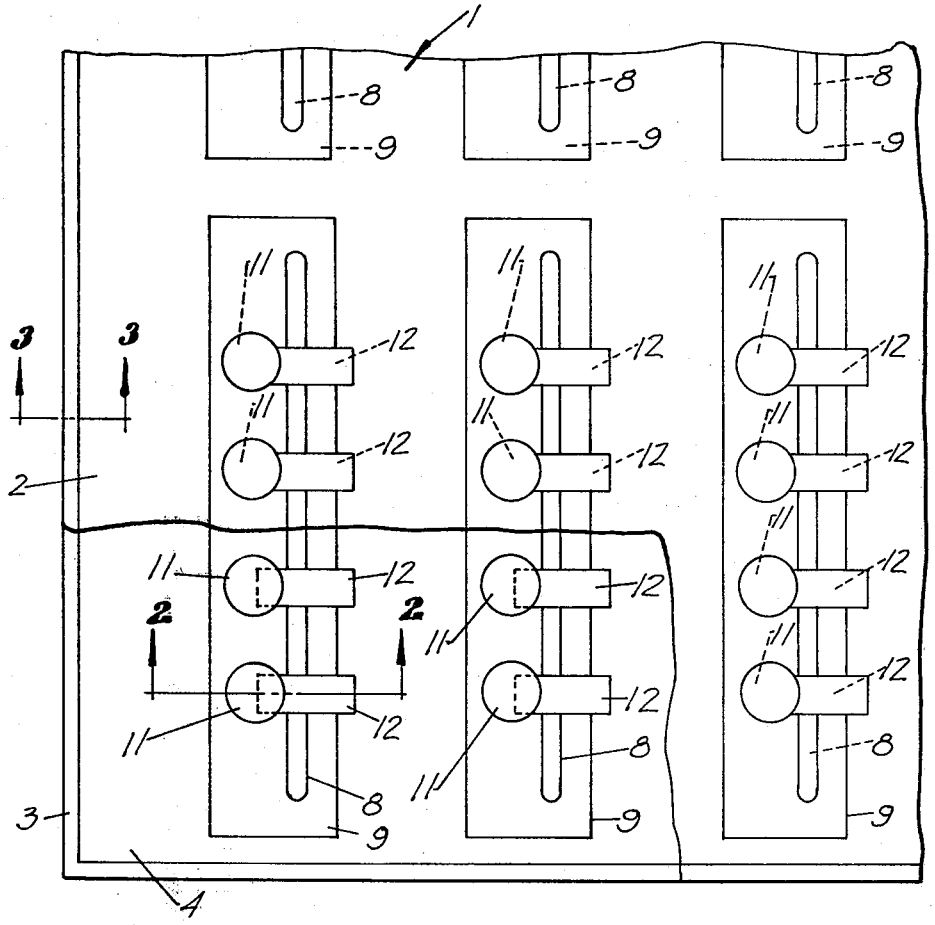
FIG. 1 is a fragmentary plan view of one laminated embodiment of the microwave energy moderator of the present invention with a portion of the upper thermoplastic lamina removed.

A first embodiment of the laminated microwave energy moderator of the present invention is illustrated in FIGS. 1 through 4 and like parts have been given like index numerals. As used herein and in the claims, the terms "laminate" and "laminated" are not intended to be restricted to structures wherein each lamina, ply or layer is permanently bonded or otherwise affixed to the adjacent ones. Rather, these terms are used in their broader sense indicating multi-layered or multi-ply structures. It will also be understood that in the specification and claims the terms "top" and "bottom" are used as a matter of convenience only. The moderators of the present invention can be used in any required orientation and do not specifically have a top or a bottom.

The moderator of FIGS. 1 through 4 is generally indicated at 1. The moderator 1 has a top layer or lamina 2 of thermoplastic material (see FIGS. 1, 3 and 4) and a bottom layer of lamina 3 of thermoplastic material (see FIGS. 1, 2, 3 and 4). It will be understood that in FIG. 2 (and in FIGS. 6 and 7 to be described hereinafter) the thickness of the various laminae and elements of the moderators of the present invention has been greatly exaggerated for purposes of clarity.

The top and bottom thermoplastic laminae 2 and 3 of moderator 1 should be electrically insulative so as to preclude arcing to the oven walls, to a vessel or utensil of which the moderator may form a part, or between adjacent portions of electrically conductive portions or components of the moderator. The laminae 2 and 3 should be characterized by a high dielectric voltage rating to withstand high voltages and by a low dielectric loss factor so as not to be self-heating. The outer or top and bottom laminae 2 and 3 must be substantially transparent to microwave energy and preferably are visually transparent so that when the moderator has changed its state from being substantially microwave energy transparent to being substantially less microwave energy transparent, this change of state can be readily discerned visually. It is also preferable, when the moderator is used in the cooking of foods in a microwave oven, that the top and bottom laminae 2 and 3 be substantially impervious to many vapors and liquids encountered in cooking. Finally, the laminae 2 and 3 should have relatively high melting points so that they can withstand the temperatures normally encountered in microwave oven cooking or the like.

Exemplary materials, which meet all the requirements above and the above stated preferred conditions, include polypropylene, polyethylene, and polyethylene terephthalate (a polyester material sold by the E. I. DuPont DeNemours and Company, Inc. of Wilmington, Del. under the trademark Mylar). Of these materials polyethylene has the lowest melting point and polypropylene is generally preferred.

Figure 2:
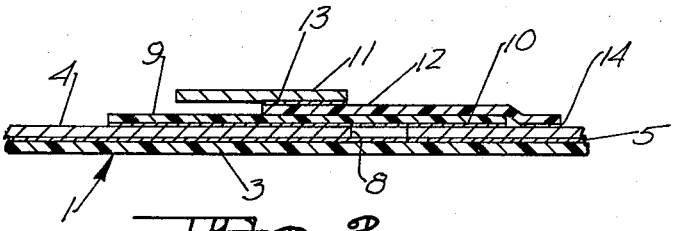
FIG. 2 is a cross sectional view taken along section line 2—2 of FIG. 1.
Figure 3:
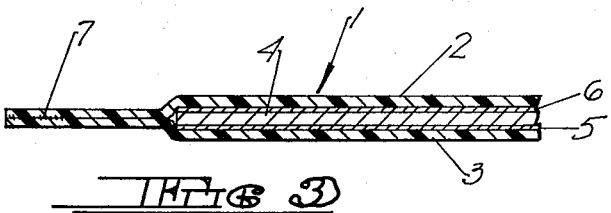
FIG. 3 is a cross sectional view taken along section line 3—3 of FIG. 1.

Adjacent the bottom lamina 3 there is located a lamina 4 which is reflective to microwave energy. Excellent results have been achieved with lamina 4 of aluminum foil, which is a good electrical conductor. While the microwave energy reflective lamina 4 need not be adhered to either of the top and bottom laminae 2 and 3, it is preferably affixed at least to the bottom lamina 3. This will tend to prevent undesired shifting or crumpling of the microwave energy reflective lamina 4 within the structure. The manner in which the reflective lamina is affixed to the bottom lamina 3 does not constitute a limitation on the present invention. It may, for example, be overall or spot bonded to the lamina 3 by adhesive. Alternatively, the thermoplastic lamina 3 could be cast or extruded directly onto the reflective lamina 4. It would also be within the scope of the invention to affix lamina 4 to lamina 3 by lines of weld or adhesive. In FIGS. 2 and 3, the lamina 4 is illustrated as being affixed to the lamina 3 by an overall layer of adhesive 5. It would also be within the scope of the invention to secure (in any of the above mentioned ways) the lamina 4 to the top lamina 2, wherever these laminae come into direct contact. This is illustrated in FIG. 3 by the layer of adhesive 6.

The top and bottom laminae 2 and 3 extend slightly beyond the edges of lamina 4, about the periphery of the moderator 1. The peripheral edges of laminae 2 and 3 are joined together to obviate electrical arcing between the microwave energy reflective lamina 4 and the oven walls, or any metallic utensil or vessel, or metallic portions of other moderators. This again may be accomplished by adhesive means, or the edges of laminae 2 and 3 may be directly heat sealed together as shown at 7 in FIG. 3.

In the embodiment shown in FIG. 1, the microwave energy reflective lamina 4 is illustrated as having a plurality of identical slots 8 formed therein. The length of the slots 8 is perferably related to the wavelength of the incident microwave energy. For example, when microwave energy at a nominal frequency of 2,450 MHz is used, the nominal wavelength at this frequency is 12.2 cm. As a consequence, the slots are preferably about 12.2 cm long so that the slots will transmit the majority of the incident microwave energy. The width of slots 8 is limited largely by the fact that the width should be sufficient to prevent arcing thereacross. To this end, it has been found that the slots 8 should not be narrower than about 3 mm, and a slot width within the range of from about 3 mm to about 6 mm is preferred. Also the slots 8 preferably have rounded ends to obviate sharp corners inasmuch as sharp corners cause high intensity local electric fields which, under some circumstances, precipitate spontaneous electrical arcing.

Figure 4H:
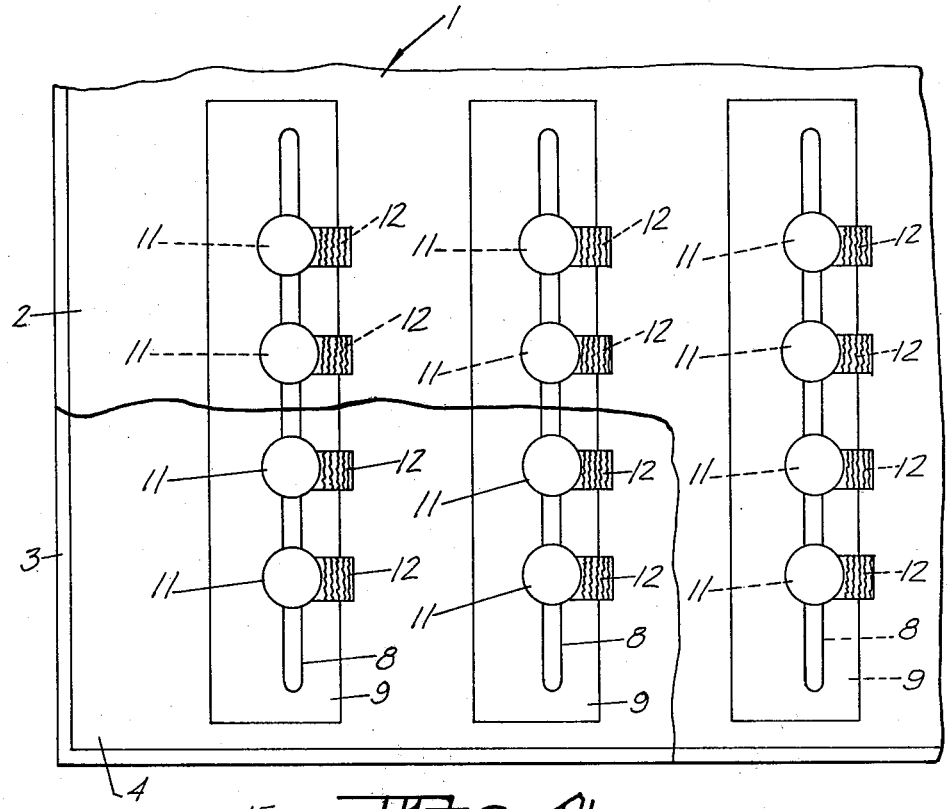
FIG. 4 is a fragmentary plan view similar to FIG. 1 and illustrating the slot-bridging members in their slot-bridging positions.

It will be evident from FIGS. 1, 2 and 4 that the slots 8 and that portion of reflective lamina 4 immediately adjacent them are covered by insulative elements 9. The insulative elements 9 should meet all of the same requirements as the material from which laminae 2 and 3 are made and preferably the same preferred conditions as well. Thus, the insulative elements 9 may be made of the same material from which laminae 2 and 3 are made. However, excellent results have been achieved when the insulative elements 9 have been made of polytetrafluorethylene tape such as Teflon (Teflon is a registered trademark of The E. I. DuPont DeNemours and Company, Inc. of Wilmington, Del.). A Teflon tape which has been used with success is sold under the trade name Temp-R-Tape by the Connecticut Hard Rubber Company of New Haven, Conn. Such Teflon tape is coated on one side with adhesive, has a thickness of about one-third ($\frac{1}{3}$) mm and meets all of the requirements set forth for the materials from which laminae 2 and 3 are made and all of the preferred conditions as well. As is clearly shown in FIG. 2, the insulative elements 9 are affixed directly to the microwave energy reflective laminae 4 by the adhesive layer 10. The Teflon tape has another advantage in that it provides an excellent, relatively slippery surface over which the slot-bridging means (next to be described) may be shifted.

Each slot 8 is provided with a plurality of identical bridging members, all of which have been designated by index numeral 11. The slot-bridging members 11 must be microwave energy opaque and may be made of aluminum foil like microwave energy reflective lamina 4. In the embodiment illustrated, each slot-bridging member 11 is shown to be circular in configuration. The peripheral configuration of the slot-bridging members does not constitute a limitation, although sharp corners or other edge discontinuities should be avoided. A circular configuration has the further advantage that no sharp corners are presented which might possibly result in the jamming or distortion of the slot-bridging member as it is shifted from its inactive position to its slot-bridging position.

In FIGS. 1 and 2, slot-bridging members 11 are illustrated in their inactive positions, to one side of their respective slots 8. Each slot-bridging member 11 is attached to a tether 12. Since all of the tethers are identical, they have all been designated by index numeral 12. Each slot-bridging member 11 and its tether 12 may be affixed together by any appropriate means such as adhesive layer 13 (see FIG. 2). As is also most clearly shown in FIG. 2, each tether 12 extends across its respective slot 8, above its respective insulative element 9 and with its free end affixed directly to microwave energy reflective lamina 4 by any appropriate means such as adhesive layer 14. The tethers 12 must be substantially microwave energy transparent and must be made of a material that will shrink within a desired predetermined temperature range. Exemplary materials from which the tethers 12 can be made include heat shrinkable polypropylene and polyethylene. Such materials are available having a nominal shrink capacity of up to about 40% and can be obtained in embodiments which will shrink over various predetermined temperature ranges. Such shrink material can be obtained wherein the shrinking characteristics are either biaxial or unidirectional. It will be understood that each insulative element 9 is sufficiently large and so configured that it substantially obviates arcing between the slot-bridging members resting thereon and the microwave energy reflective lamina 4.

The structure of moderator 1 of FIGS. 1 through 4 having been set forth above, its mode of operation may be described as follows. As indicated above, when used in heating or cooking food products in a microwave oven, the moderator 1 can be incorporated in a wrap or bag for the food product or as a disposable part of a reuseable vessel or as part of a disposable vessel for the food product. In use, the moderator should be free of such bends or folds as might preclude proper operation of the slot-bridging members 11. Prior to use, and during the cooking or heating operation, the moderator 1 will be in the state illustrated in FIGS. 1 and 2 with the slot-bridging members 11 disposed in their inactive positions as shown. During the heating or cooking process, the moderator 1 will serve much the same purpose as a static microwave energy moderator, permitting the transmission therethrough of a substantial part of the impinging microwave energy while providing a more uniform microwave energy field for the material being heated or cooked, resulting in more uniform doneness. When the moderator passes through a preselected temperature range through which the shrink material of tethers 12 reacts, the tethers 12 will shrink and pull the slot-bridging members 11 from their inactive or passive positions to their slot-bridging positions as illustrated in FIG. 4. Each slot 8, as a result, will effectively be subdivided by the slot-bridging members into a plurality of substantially shorter slots and the overall microwave energy transmission of the slots will be substantially reduced. All of the materials used in the moderator 1 are substantially non-self heating. Therefore, it will be understood that the shrink material tethers 12 react to temperatures reached by heat imparted thereto either by conduction if the moderator 1 is in contact with the food product being heated or by convection and/or radiation if the moderator 1 is not in contact with the food product being heated. Under some circumstances all three modes of heat transmission may come into pay. The moderator 1, when in its state illustrated in FIG. 4, substantially reduces the microwave energy passing through slots 8 to the food product being cooked or heated and therefore reduces the criticality of the timing required for proper cooking or heating and the attention requirements of the operator of the microwave oven. The danger of overcooking is also substantially obviated.

The amount of microwave energy transmitted by a slot 8 is a function of the wavelength of the incident microwave energy, the polarization of the E (electric) field, the length of the slot and its shape. The microwave energy transmission of moderator 1, when in its state illustrated in FIG. 1, can be varied by varying the dimensions and the number of the slots 8.

The microwave energy transmission characteristics of the moderator 1, when in the activated state illustrated in FIG. 4, can be varied by varying the amount of open area remaining in the slots 8 once the slot-bridging members 11 have achieved their slot-bridging positions (i.e. the dimenions or spacing of the slot-bridging members), and by varying the thickness of insulative elements 9. It will be understood by one skilled in the art that the thinner the insulative elements 9 are, the less leakage of microwave energy will be permitted therethrough and beneath the slot-bridging members 11.

Finally, the temperature range over which the moderator 1 will transition from its substantially microwave energy transparent state to its activated state wherein it is substantially less transparent to microwave energy will depend upon the appropriate selection of the heat shrink temperature range of the material used for tethers 12.

Figure 5:
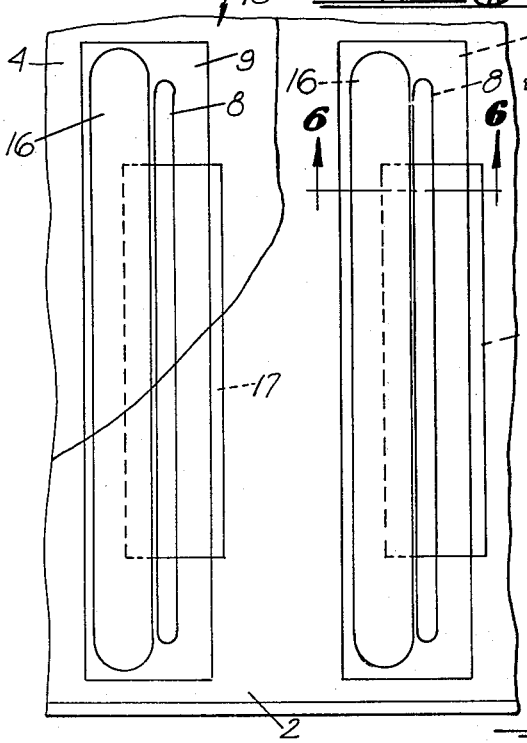
FIG. 5 is a fragmentary plan view of another embodiment of the microwave energy moderator of the present invention with a portion of the top thermoplastic lamina removed.
Figure 6:
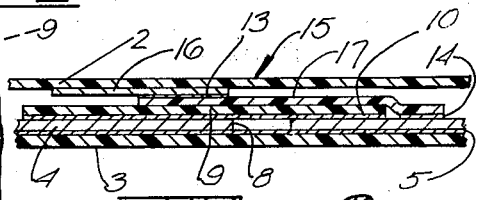
FIG. 6 is a cross sectional view taken along section line 6—6 of FIG. 5.

Reference is now made to FIGS. 5 and 6 wherein another embodiment of microwave energy moderator of the present invention is generally indicated at 15. The embodiment of FIGS. 5 and 6 is similar to that of FIGS. 1 through 4 and, where applicable, like parts have been given like index numerals. The embodiment of FIGS. 5 and 6 differs from that of FIGS. 1 through 4 only with respect to the slot-bridging means and its tether. In this embodiment, each slot 8 is provided with a single slot-bridging member 16 which is slightly longer and slightly wider than its respective slot 8. Each slot-bridging member is provided with a single tether 17. The tether 17 is of such dimensions that it can adequately shift its respective slot-bridging member 16 from its inactive position as illustrated in FIG. 5 and 6 to its activated or slot-bridging position wherein it completely covers its respective slot 8.

All of the elements of moderator 15 may be made of the same materials (having the same characteristics) as described with respect to equivalent elements of moderator 1. The operation of moderator 15 is the same as that described for moderator 1 with the exception that when the moderator 15 is in its microwave energy opaque state, each of its slots 8 will be fully covered by its slot-bridging member 16. Thus the only avenue for microwave energy transmission through moderator 15, when in its microwave energy opaque state, is diagonally directed leakage through the thickness of insulative element 9.

Figure 7:
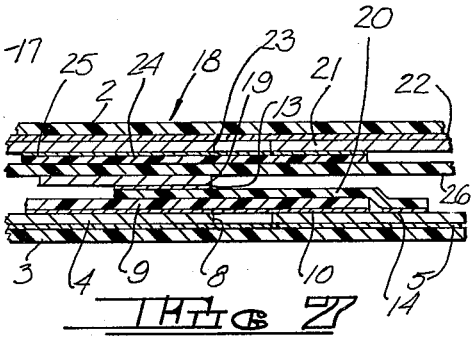
FIG. 7 is a cross sectional view similar to FIG. 6 and illustrating another embodiment of the present invention utilizing two microwave energy reflective laminae.

Reference is now made to FIG. 7 which constitutes a fragmentary cross sectional view of yet another embodiment of microwave energy moderator, generally indicated at 18. The moderator 18 is again similar to moderator 1, and again (where applicable) like parts have been given like index numerals. To this end, the moderator 18 has a top thermoplastic lamina 2, a bottom thermoplastic lamina 3, and a microwave energy reflective lamina 4 having a plurality of slots formed therein, one of which is indicated at 8. The microwave energy reflective lamina 4 may, if desired, by adhered to bottom thermoplastic lamina 3 by any appropriate means such as adhesive layer 5. An insulative element 9 covers the slot 8 and is affixed to the microwave energy reflective lamina 4 by adhesive layer 10. The moderator 18 is provided with a slot-bridging means for each of its slots 8. In FIG. 7 the slot-bridging means is indicated at 19 and can take the form of one of a plurality of discs 11 as shown in FIGS. 1, 2 and 4 or as a single slot-bridging element of the type shown at 16 in FIGS. 5 and 6. As a result, the tether (indicated in FIG. 7 at 20 may take the form of a tether 12 of FIGS. 1, 2 and 4 or a tether 17 of FIGS. 5 and 6.

The embodiment of FIG. 7 differs from that of FIGS. 1 through 4 or FIGS. 5 and 6 primarily in that a second microwave energy reflective lamina 21 is provided adjacent the top thermoplastic layer 2. If desired, the microwave energy reflective lamina 21 may be affixed to the top thermoplastic lamina 2 by any appropriate means such as an adhesive layer 22.

The upper microwave energy reflective lamina 21 is provided with a plurality of slots, one of which is indicated at 23. The slot 23 is identical to the slot 8 of microwave energy reflective lamina 4 and, as will be noted from FIG. 7, is in registry therewith. In order to prevent arcing between the slot-bridging member 19 and the upper microwave energy reflective laminae 21, a second insulative element 24 is provided underlying slot 23. It will be understood that the insulative element 24 may be identical to insulative elements 9 and is affixed to the upper microwave energy reflective lamina 21 by an appropriate adhesive layer 25. To further guard against arcing between microwave energy reflective laminae 4 and 21, an additional thermoplastic lamina 26 (similar to laminae 2 and 3) is incorporated in the structure.

The operation of the embodiment of FIG. 7 is similar in all respects to that of moderator 1 or moderator 15, depending upon the nature of the slot-bridging member 19 and tether 20. When the slot-bridging member 19 is similar to slot-bridging member 16 of FIGS. 5 and 6, the only path of travel for microwave energy when the moderator 18 is in its microwave energy opaque state is through the thickness of insulative elements 9 and 24. This constitutes a more tortuous path than just through insulative element 9 in FIG. 6, for example, and thus results in more complete blockage of microwave energy transmission.

In all of the embodiments where adhesive is used, the adhesive must be so chosen as to be capable of joining together the various parts as intended; to be capable of withstanding the cooking temperatures to which it will be subjected and to be appropriate for use in a microwave oven environment. Numerous adhesives are readily available for this purpose and examples of such adhesives include an adhesive sold by Eastman Chemical Products, Inc. of Kingsport, Tenn. under the trademark Eastman 910, a spray adhesive type 3M-No. 77 which is available from the Minnesota Mining and Manufacturing Company, 3M Center, St. Paul, Minn. and Type Cascorex EZ-7908 which is a water base ethylenevinyl acetate adhesive, and which is available from Borden Chemical, Division of Borden, Columbus, Ohio.

Selection of all of the other components of the moderators of the present invention should be made depending upon the intended use. Thus, all of the elements should be of such nature as to be appropriate for use in a microwave oven environment when the moderators of the present invention are intended for use in microwave energy cooking.

EXAMPLE I

A microwave energy moderator of the type illustrated in FIGS. 1 through 4 was assembled. The microwave energy reflective lamina 4 and the slot-bridging members 11 were made of aluminum foil having a thickness of about one-tenth (1/10) mm. The top and bottom thermoplastic laminae 2 and 3 were made of heat sealable Mylar having a thickness of about one-fortieth (1/40) mm. The insulative elements 9 were made of Teflon tape having a thickness of about one-quarter ($\frac{1}{4}$) mm and the tethers 12 were made of polyvinylchloride shrink wrap having a thickness of about one-twentieth (1/20) mm and a shrinking capability of up to about 40% through the temperature range of from about 60° C. to about 80° C. The adhesive used was the above mentioned Eastman 910 adhesive.

The overall dimension of the microwave energy reflective lamina 4 was about 25 cm by about 32 cm. The lamina 4 was provided with two rows of 5 slots each, the slots extending longitudinally in that direction of lamina 4 having a 32 cm dimension. Each slot was about 12 cm long and about 3 mm wide. The distance between adjacent slots was about 38 mm and the distance between the outermost slots of each row thereof and the adjacent parallel edge of lamina 4 was about 50 mm.

Each slot was provided with three slot-bridging members having a disc-shape and a diameter of about 13 mm.

The moderator was used as a cover for a vessel having 400 milliliters of tap water as its contents. The microwave energy to which the moderator was subjected had a frequency of 2,450 MHZ.

It was determined that the moderator with all of its slot-bridging members in their inactive positions transmitted about 66% of the incident microwave energy. With the slot-bridging members in their slot-bridging positions, the moderator transmitted about 23% of the incident microwave energy.

EXAMPLE II

A microwave energy moderator of the type illustrated in FIG. 7 was assembled. The thermoplastic laminae 2, 3 and 26 were made of heat sealable Mylar having a thickness of about one-fourth (1/40) mm. Insulative element 9 and 24 were made of Teflon tape having a thickness of about one-quarter (¼) mm. The microwave energy reflective laminae 4 and 21 and the slot-bridging members 19 (similar to those shown at 16 in FIGS. 5 and 6) comprised one-tenth (1/10) mm thick aluminum foil. The tethers 20 (like those illustrated at 17 in FIGS. 5 and 6) were made of polyvinylchloride shrink wrap of about one twentieth (1.20) mm thickness and a shrink capability of up to about 40% through a temperature range of from about 60° C. to about 80° C. Again Eastman 910 adhesive was used.

The moderator of this example had overall dimensions of about 50 cm by 32 cm. The moderator was provided with a total of 20 slots of about 12 cm by 3mm.

The moderator of this example, with its slot-bridging members in their inactive positions, transmitted about 66% of the incident microwave energy. When the slot-bridging members were shifted to their slot-bridging positions, the moderator transmitted only about 1% of the incident microwave energy.

What we claim is:

1. A macroscopically dimensionally stable, dynamically temperature responsive microwave energy moderator comprising a sheet-like laminate comprising at least one lamina of microwave energy reflective material with at least one aperture formed therein of such dimensions as to enable the passage therethrough of a substantial portion of impinging microwave energy of a predetermined nominal frequency, said laminate further comprising temperature responsive means for substantially reducing the transmissibility of microwave energy through said aperture without macroscopically reducing the size of said moderator as the temperature of said temperature responsive means is elevated through a predetermined temperature range.

2. A dimensionally stable, temperature responsive microwave energy moderator comprising a sheet-like laminate having at least one lamina of microwave energy reflective material with at least one aperture formed therein of such dimensions as to enable the passage therethrough of a substantial portion of impinging microwave energy of a predetermined nominal frequency, at least one aperture-bridging microwave energy reflective member is provided together with means responsive to a predetermined temperature range to shift said aperture-bridging member from an inactive position to a position bridging said aperture so as to reduce the transmission of the microwave energy through said aperture, and top and bottom laminae of electrically insulative, microwave energy transmitting material joined together at their peripheral edges with said lamina of microwave energy reflective material, said aperture-bridging means and said temperature responsive means located therebetween.

3. The structure claimed in claim 2 wherein said aperture-bridging member is so sized as to completely cover said aperture when in said aperture-bridging position.

4. The structure claimed in claim 2 wherein said at least one aperture in said microwave energy reflective material is in the form of an elongated slot, and including a plurality of aperture-bridging members for said slot, said aperture-bridging members when in said aperture-bridging position being so located as to divide said elongated slot into a plurality of slot segments to reduce said microwave energy transmission through said elongated slot.

5. The structure claimed in claim 3 wherein said microwave energy reflective lamina and said aperture-bridging member both comprise aluminum foil, said aperture-bridging member being located to one side of said aperture when in said inactive position, said temperature responsive means to shift said aperture-bridging member from said inactive position to said aperture-bridging position wherein it covers said aperture comprises a tether extending across said aperture and being attached at one end to said aperture-bridging member and at its other end to said reflective lamina on the opposite side of said aperture from said aperture-bridging member, said tether comprising a microwave energy transmitting material, heat shrinkable within said predetermined temperature range to draw said aperture-bridging member from its inactive position to said aperture-bridging position, and means to electrically insulate said aperture-bridging member from said microwave energy reflective lamina to prevent arcing therebetween.

6. The structure claimed in claim 3 wherein said microwave energy reflective lamina and said aperture-bridging members comprise aluminum foil, each of said aperture-bridging members being located to one side of said slot when in said inactive position, said temperature responsive means to shift said aperture-bridging members from said inactive position to said aperture-bridging position comprising a tether for each of said aperture-bridging members, each of said tethers extending across said slot and being attached at one end to its respective aperture-bridging member and at its other end to said microwave energy reflective lamina on the opposite side of said slot from said aperture-bridging member, each of said tethers comprising microwave energy transmitting material heat shrinkable within said predetermined temperature range to draw its respective aperture-bridging menber from said inactive position to said aperture-bridging position, and means to electrically insulate said aperture-bridging members from said microwave energy reflective lamina to prevent arcing therebetween.

7. The structure claimed in claim 5 wherein said means to electrically insulate said aperture-bridging member from said microwave energy reflective lamina comprises a layer of microwave energy transmitting, electrically insulative material affixed to said microwave energy reflective lamina over said aperture and the adjacent portion of said last mentioned lamina to underlie said aperture-bridging member when in said inactive and aperture-bridging positions.

8. The structure claimed in claim 5 including a plurality of said apertures in said microwave energy reflective lamina, an aperture-bridging member, a tether and means to electrically insulate said aperture-bridging member from said microwave energy reflective lamina for each of said apertures.

9. The structure claimed in claim 5 including a second microwave energy reflective lamina located above said first mentioned microwave energy reflective lamina and said aperture-bridging member, an intermediate electrically insulative microwave energy transmitting lamina being located above said first mentioned microwave energy reflective lamina and said aperture-bridging member and below said second microwave energy reflective lamina, said second microwave energy reflective lamina having at least one aperture therein overlying and co-extensive with said at least one aperture in said first mentioned microwave energy reflective lamina.

10. The structure claimed in claim 6 wherein said means to electrically insulate said aperture-bridging members from said microwave energy reflective lamina comprises a layer of microwave energy transmitting, electrically insulative material affixed to said microwave energy reflective lamina over said aperture and the adjacent portion of said last mentioned lamina to underlie said aperture-bridging members when in said inactive and aperture-bridging positions.

11. The structure claimed in claim 6 including a plurality of said slots in said microwave energy reflective lamina, a plurality of aperture-bridging members, tethers for each of said aperture-bridging members and means to electrically insulate said aperture-bridging members from said microwave energy reflective lamina for each of said slots.

12. The structure claimed in claim 6 including a second microwave energy reflective lamina located above said first mentioned microwave energy reflective lamina and said aperture-bridging members, an intermediate electrically insulative microwave energy transmitting lamina being located above said first mentioned microwave energy reflective lamina and said aperture-bridging members and below said second microwave energy reflective lamina, said second microwave energy reflective lamina having at least one slot therein overlying and co-extensive with said at least one slot in said first mentoned microwave energy reflective lamina.

13. The structure claimed in claim 8 including a second microwave energy reflective lamina located above said first mentioned microwave energy reflective lamina and said aperture-bridging members, an intermediate electrically insulative microwave energy transmitting lamina being located above said first mentioned microwave energy reflective lamina and said aperture-bridging members and below said second microwave energy reflective lamina, said second microwave energy reflective lamina having a plurality of apertures therein each overlying and co-extensive with one of said apertures in said first mentioned microwave energy reflective lamina.

14. The structure claimed in claim 11 including a second microwave energy reflective lamina located above said first mentioned microwave energy reflective lamina and said aperture-bridging members, an intermediate electrically insulative microwave energy transmitting lamina being located above said first mentioned microwave energy reflective lamina and said aperture-bridging members and below said second microwave energy reflective lamina, said second microwave energy reflective lamina having a plurality of slots therein each overlying and co-extensive with one of said slots in said first mentioned microwave energy reflective lamina.

* * * * *